US005799948A

United States Patent [19]

Moberg

[11] Patent Number: 5,799,948

[45] Date of Patent: Sep. 1, 1998

[54] LEACHING PROTECTOR

[76] Inventor: Gerth Moberg, PL Helgenäs, S-590 98 Edsbruk, Sweden

[21] Appl. No.: 849,818

[22] PCT Filed: Oct. 14, 1996

[86] PCT No.: PCT/SE96/01301

§ 371 Date: Jun. 13, 1997

§ 102(e) Date: Jun. 13, 1997

[87] PCT Pub. No.: WO97/14929

PCT Pub. Date: Apr. 24, 1997

[30] Foreign Application Priority Data

Oct. 17, 1995 [SE] Sweden ..... 9503617

[51] Int. Cl.[6] ..... F41J 1/12

[52] U.S. Cl. ..... 273/410

[58] Field of Search ..... 273/410

[56] References Cited

U.S. PATENT DOCUMENTS 4,728,109 3/1988 Simonetti ..... 273/410
5,255,924 10/1993 Copius ..... 273/410
5,435,571 7/1995 Wojcinski et al. ..... 273/410
5,564,712 10/1996 Werner ..... 273/410

FOREIGN PATENT DOCUMENTS 0 683 375 A1 11/1995 European Pat. Off. .
2 242 730 10/1991 United Kingdom .

*Primary Examiner*—William H. Grieb
*Attorney, Agent, or Firm*—Rolf Fasth Fasth Law Firm

[57] ABSTRACT

A device for limiting, controlling and disposing leached lead. Shooting is made through an elastic layer, providing a watertight cover which closes after the passage of a projectile, the latter subsequently being arrested in a projectile-arresting material kept in an enclosed space created by a watertight layer. Precepition water penetrating the minimal projection penetrating holes is drained via the arresting material, along the inclined insides of the watertight layer, down to a lowermost point where the water is collected by a drainage line. The drainage water is discharged through a pipe to a closed reservoir or to a filter.

9 Claims, 2 Drawing Sheets

LEACHING PROTECTOR

The present invention relates to an outdoor protection device, preventing the leaching of lead from lead projectile particles contained in a projectile-arresting material, and allowing repeated shooting with a maintained function.

BACKGROUND OF THE INVENTION

During practice and competition shooting with powder-propelled projectiles at shooting ranges, the shots are aimed at target areas in the shape of ring-marked square targets or figure-like targets of various sizes and shapes. Behind the targets there is generally a projectile arresting arrangement.

The outdoor type arresting arrangement generally consists of ground masses or gravel being dozed into an elongated bank, or as an alternative, the arrester is a natural slope. The extension of the arrester is determined by the target area, and beyond that, by the regulated safety distances for the type of fire arms used and the manner of shooting. To avoid ricochets from the arresting material in e.g. arresting banks, these are supplemented by projectile-arresting material on the section being shot at. Such a material is carefully selected for the type of shooting and will arrest the projectiles inside the layer.

One of the problems with this type of projectile arrester is that the material is unprotected against precipitation, leading to large amounts of unwanted lead and lead compounds being leached by water and spread in an uncontrolled manner into the surrounding environment.

There are environmental demands for limiting these lead emissions, and imperative legislation concerning measures for cleansing of lead from shooting banks is to be expected.

A further problem is the freezing of the projectile-arresting material under extreme cold conditions, caused by large amounts of bound water. This limits the use for safety reasons.

SUMMARY OF THE INVENTION

The object of the leaching protector according to the present invention is to reduce considerably the amount of leached lead and lead compounds from the projectile-arresting material, and at the same time to prevent uncontrolled spreading of the drainage water to the surrounding environment.

This object is achieved by a device, which in short implies that shooting is performed against a projectile arrester which on the top surface has an elastic layer which, after the passage of the projectile, exhibits a very small entry hole, and that the projectile is subsequently arrested in the projectile-arresting material beneath it. This material in turn is contained in an enclosed space, having a bottom and sides consisting of a watertight layer, with the projectile-arresting material as a distance material, and with said top surface layer as a water-repelling cover. The enclosed space is drained by a drainage system. This means that surface water which has penetrated the elastic top layer via the minute projectile entry holes, or in other ways, is taken care of by drainage through the projectile-arresting material beneath it and conducted along the water-tight side and bottom layers down to the lowermost point of the enclosed space, where the drainage water is collected. From there, said water is drained by e.g. a closed pipe conduit to an enclosed reservoir or to a filtration plant.

The volume of lead-contaminated drainage water to be collected according to the present invention is of negligible size compared to the volumes which are today leached to the environment, and the disposal of this small amount of drainage water will cause only minimal problems.

The projectile-arresting material, which is kept protected from precipitation, may be optimised regarding its projectile-arresting capacity. Furthermore, the invention has the advantage of the elastic top layer also providing protection from winds, and it may provide ricochet protection. The protected location of the projectile-arresting material also means less freezing risk during extreme cold conditions.

The present invention provides the advantage of being able to use existing, already lead-contaminated projectile-arresting materials, as this means that further leaching to the environment is prevented when such materials, according to the principles of the invention, are placed in an enclosed space.

The invention allows the projectile-arresting material to be utilised during a substantially longer period of time before a lead removal, which will now only be necessary when the arresting material has become so contaminated by projectile remainders that it has ceased to function as a projectile arrester.

The present invention, before the use of previously utilised projectile-arresting material, only needs a rinsing out of larger projectile remainders for the sake of safety, and this can be made selectively, without concern to lead cleansing, as the roughly sorted material is intended for replacing into the enclosed space.

The degree of contamination of the projectile-arresting material may be monitored continuously by means of sampling, or by sampling the drainage water.

The invention may comprise a device behind one single target, a group of targets, or it may be arranged as a total protection of the entire shooting safety area. The construction is designed in accordance with these areas of use and in accordance with the selected arresting material, as well as with the degree of utilisation.

Thus, the object of this invention is to enclose the projectile-arresting material, and thereby the lead, into an enclosed space, preventing precipitation water from uncontrollably leaching the lead from the projectiles having been stopped and collected in the device.

This object is achieved by a device according to patent claim 1.

DESCRIPTION OF A PREFERRED EMBODIMENT

The invention will be described in more detail below, with reference to the enclosed drawings, in which.

Figure 1:
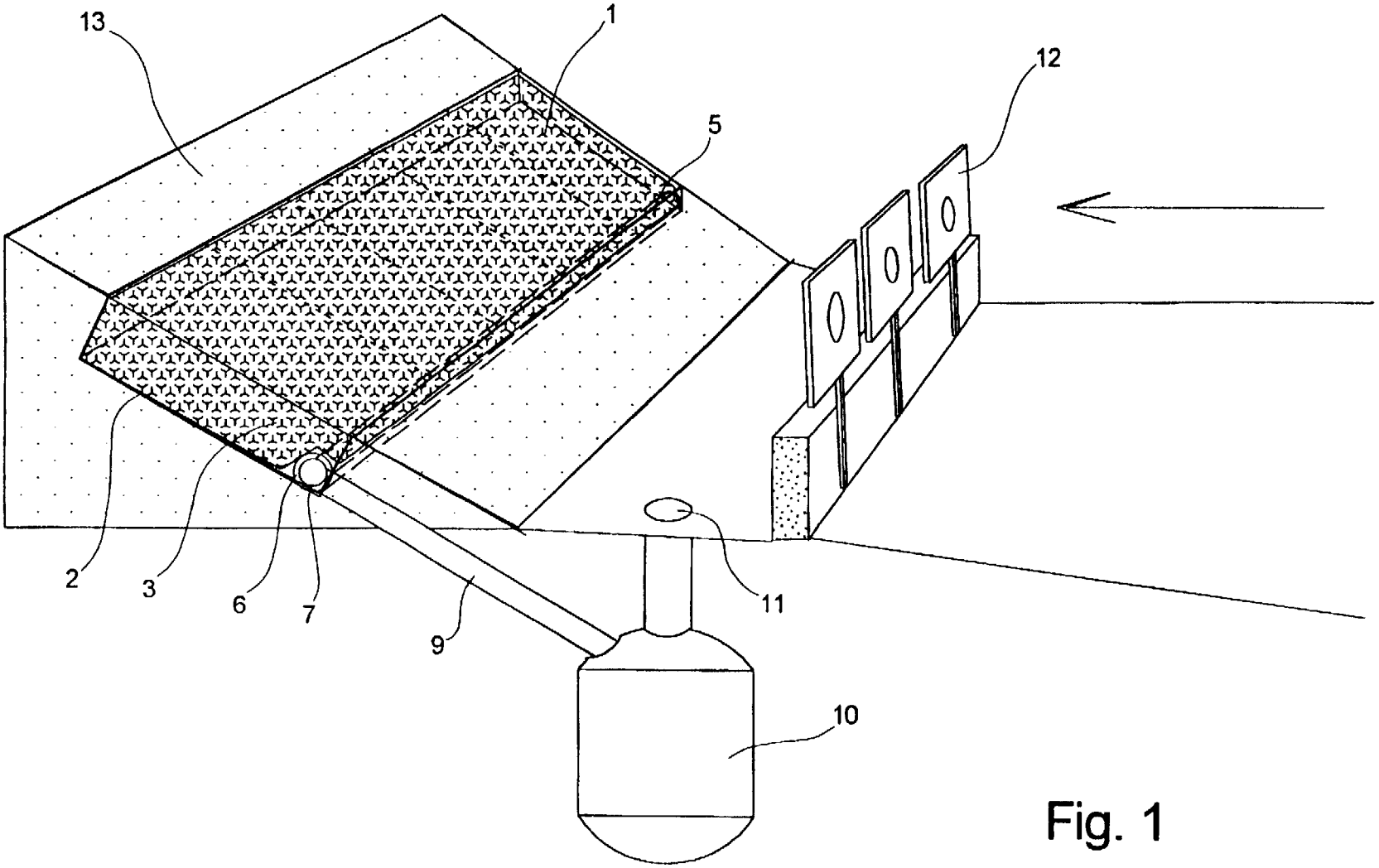
FIG. 1 shows a schematic perspective view of a leaching protector according to the invention.
Figure 3:
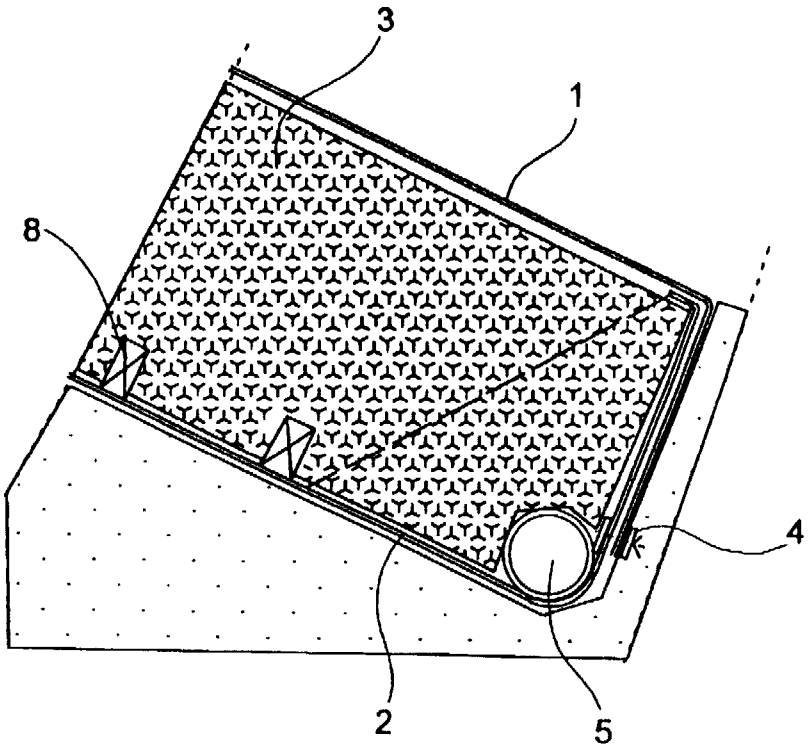
FIG. 3 shows a partial sectional view of the lower part of the leaching protector according to the invention.
Figure 2:
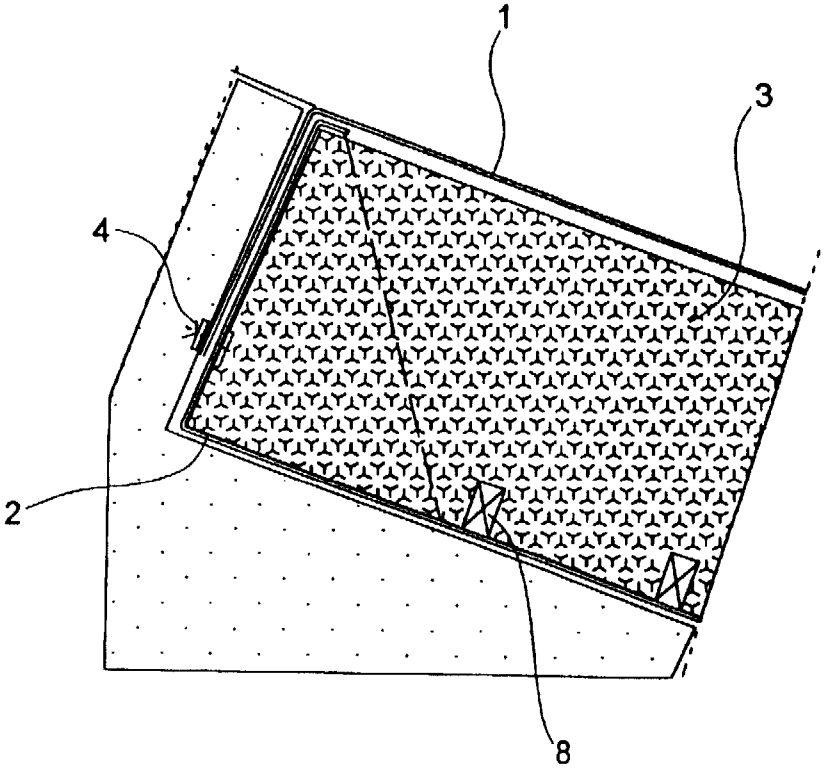
FIG. 2 shows a partial sectional view of the upper part of the leaching protector according to the invention.

Referring now to the figures, a preferred embodiment of the leaching protector according to the invention exhibits, behind targets 12, relative to the ground plane, an inclined construction comprising:

A covering layer 1, made of rubber, fastened to a backing layer 2 with upturned sides, made of fiberglass-reinforced polyester resin, by means of fastening devices 4 comprising flat steel bars and screw connections, the flat steel bars sealing the covering layer against the backing layer through suitable tightening of the screw connections. The covering layer 1 rests upon the projectile-arresting material 3, and it is joined together with vulcanised overlapping joints. The terminating ends of the covering layer 1 are, in all directions, fastened to the backing layer 2 by means of said fastening devices 4. At the lowermost end, the covering layer 1 is fastened to a collection gutter formed by the backing layer 2, likewise by means of a fastening device 4.

A backing layer 2 made of fiberglass-reinforced polyester resin, arranged onto an inclined surface of e.g. ground material which has been laid as a bank 13, with an inclination selected a.o. in accordance with the inner friction of the arresting material 3. The backing layer 2 is shaped by forming side walls and upper and lower longitudinal walls into a box-shaped structure, adapted to the selected arresting material and the locational demands applied to the device. Glued-on supports of fiberglass-reinforced polyester may be necessary as a support for the backing layer 2 at the upper and lower walls in case the arresting material layer is thick.

A projectile-arresting material 3, filled into the watertight box formed by the backing layer 2 and having a layer thickness and composition adapted to the type of ammunition used, and to the shooting conditions.

Fastening devices 4, made of corrosion resistant flat steel profiles, pulled together by screw connections, with layers 1 and 2 between them, into a watertight attachment.

A drain pipe 5 of perforated resin, placed at the bottom of the collection gutter formed by the fiberglass reinforced polyester at the lowermost end of the backing layer 2, and connected to a wall outlet 7.

An outlet connector 6 having a suitable dimension for connection to a discharge pipe 9, fitting in a watertight connection to said wall outlet 7.

A plastic resin wall outlet 7, glued to the side wall of the backing layer 2 at the collection gutter.

An anti-slide protector 8 may be necessary, depending on the inclination angle and the selected arresting material, in which case such devices are placed at a suitable angle on the backing layer 2 in the form of glued-in wooden ribs 8, appropriately spaced so as to prevent the selected arresting material 3 from sliding downwards.

A discharge pipe 9, conveying the collected drainage water to the reservoir 10.

A collection reservoir 10 for the drainage water.

A lid 11, sealing tightly and being removable for emptying of the tank.

The device is drained from leach water via the sealed resin pipe 9, to be collected in the closed plastic resin reservoir 10 with its lid 11 for emptying and inspection.

The scope of the invention is not limited by the embodiment described above, but only by the appended patent claims. For example, the backing layer 2 for the enclosed space containing the arresting material 3 may also be made from the same rubber material as the covering layer 1, the box shape in this case being achieved through the excavation of the bank 13. In such a case, the covering layer 1 and the backing layer 2 may preferably be constructed as one single continuous layer, joined together by vulcanised overlapping joints.

This covering layer 1 may also comprise overlapping sections that are provided with water-diverting ribs attached thereto.

I claim:

1. A leaching protector for lead at outdoor shooting ranges, comprising:

an elastic water-repelling first layer that is inclined relative to a ground level, the first layer being penetrable by projectiles;

a watertight second layer that is spaced apart a distance behind the first layer so that a space is defined therebetween;

the space being enclosed and sealed from a surrounding environment;

a projectile-arresting material disposed in the space, the material being isolated from the surrounding environment by the first and second layers; and the space being dewaterable via a drainage arrangement that is in operative engagement with the leaching protector.

2. The leaching protector according to claim 1 wherein the first layer is penetrable by projectiles, the first layer is attached to the second layer by a mechanical joint, the second layer has a watertight bottom section and the second layer has side walls that are shaped into a collection gutter for draining water, the leaching protector further comprises a drainage device at a lowermost part of the second layer, the leaching protector further comprises at least one outlet connector that is in operative waterproof engagement with a wall outlet defined in the second layer.

3. The leaching protector according to claim 2 wherein the leaching protector comprises a chemical joint.

4. The leaching protector according to claim 2 wherein the mechanical joint comprises steel profiles that are screwed together about the first and second layers.

5. The leaching protector according to claim 2 wherein the first and second layers are made from the same material.

6. The leaching protector according to claim 5 wherein the material is elastic, water-repelling and penetrable by projectiles.

7. The leaching protector according to claim 1 wherein the leaching protector is disposed onto and supported by a supporting base, the projectile-arresting material is prevented from sliding through friction against the second layer and by a supporting arrangement having fender ribs attached thereto and the first layer is a continuous layer.

8. The leaching protector according to claim 7 wherein the second layer is shaped to conform to a shape of the supporting base.

9. The leaching protector according to claim 7 wherein the first layer comprises overlapping sections that are provided with water-diverting ribs attached thereto.

* * * * *